US006546588B1

(12) United States Patent
Black

(10) Patent No.: US 6,546,588 B1
(45) Date of Patent: Apr. 15, 2003

(54) FLEXIBLE BODY CLEANSING BRUSH WITH ANGULARLY-ADAPTABLE HEAD

(76) Inventor: Joseph D. Black, 256 Melvin Ave., Staten Island, NY (US) 10314

( * ) Notice: Subject to any disclaimer, the term of this patent is extended or adjusted under 35 U.S.C. 154(b) by 0 days.

(21) Appl. No.: 09/992,329

(22) Filed: Nov. 19, 2001

(51) Int. Cl.[7] ..... A47K 7/02
(52) U.S. Cl. ..... 15/244.1; 15/144.1
(58) Field of Search ..... 15/144.1, 244.1, 15/244.2, 172, 210.1

(56) References Cited

U.S. PATENT DOCUMENTS

| | | | | |
|---|---|---|---|---|
| 750,357 | A | * | 1/1904 | Gibbons |
| 1,154,369 | A | * | 9/1915 | Browning |
| 1,478,388 | A | * | 12/1923 | Gray |
| 1,973,768 | A | * | 9/1934 | Knapp |
| 4,974,286 | A | * | 12/1990 | Stowell |
| 5,240,339 | A | | 8/1993 | Deforest et al. |
| 5,630,244 | A | * | 5/1997 | Chang |
| 5,671,497 | A | * | 9/1997 | Abdo |
| 5,898,967 | A | | 5/1999 | Wu et al. |
| 5,960,509 | A | | 10/1999 | Wu |
| 6,006,393 | A | | 12/1999 | Lynch et al. |
| 6,154,913 | A | | 12/2000 | Burton |
| 6,415,470 | B1 | * | 7/2002 | Ramrattan |

FOREIGN PATENT DOCUMENTS

| | | | |
|---|---|---|---|
| DE | 1191526 | * | 4/1965 |

* cited by examiner

*Primary Examiner*—Randall E. Chin
(74) *Attorney, Agent, or Firm*—John D. Gugliotta

(57) ABSTRACT

A flexible body cleansing brush with angularly-adaptable head is provided having an elongated, tubular body with a rubber handle positioned at one end, and an applicator/cleansing sponge located at an opposite end. A flexible elastomeric tubular coupler flexibly adjoins a primary arm to an extension arm. The flexible elastomeric coupler allows the extension arm to move pivotally, with unlimited angular relation with respect to the primary arm. The applicator/cleansing sponge is fabricated of a polysulfone/polyurethane conjugate foam which allows the sponge to retain dimensional stability when in contact with a cleansing agent, and is also durable.

5 Claims, 2 Drawing Sheets

FLEXIBLE BODY CLEANSING BRUSH WITH ANGULARLY-ADAPTABLE HEAD

RELATED APPLICATIONS

There are no previously filed, nor currently any co-pending applications, anywhere in the world.

BACKGROUND OF THE INVENTION

1. Field of the Invention

The present invention relates generally to back brushes and, more particularly, to a flexible body cleansing brush with angularly-adaptable head.

2. Description of the Related Art

Most people find it difficult to reach and wash certain areas of the body, such one's back and lower legs. Many others are faced with chronic back problems and arthritic conditions, thus making it almost impossible to reach areas of the body which require bending and twisting. Additionally, the body is undated with a multitude of various curves and contours, thus requiring a more ergonomically-conforming brush for effectively reaching and cleaning such areas; however, conventional back brushes have failed to accommodate for such curvilinear areas.

Accordingly, there is a need for a means by which to effectively reach and wash hard-to-reach areas of the body in a manner which is quick, easy, practical and effective. The development of the flexible body brush with angularly-adaptable head fulfills this need.

A search of the prior art did not disclose any patents that read directly on the claims of the instant invention; however, the following references were considered related.

U.S. Pat. No. 6,006,393 issued in the name of Lynch et al. describes a coating tool with variable flexible connection between head and handle.

U.S. Pat. No. 6,154,913 issued in the name of Burton discloses a flexibly jointed toilet brush having a head which can be deflected relative to its handle.

U.S. Pat. No. 5,898,967 issued in the name of Wu et al. describes a flexible toothbrush with an elongated flat flexible leaf-spring embedded within the body, head portion, neck portion, and end of the handle portion.

U.S. Pat. No. 5,960,509 issued in the name of Wu discloses a multi-functional back brush with a head which can be adjusted in angular position.

U.S. Pat. No. 5,240,339 issued in the name of DeForest et al. describes a body lotion applicator with applicator head pivotally mounted on tubular extension arm.

Consequently, a need has been felt for a device which can effectively reach and wash hard-to-reach areas of the body.

SUMMARY OF THE INVENTION

Therefore, it is an object of the present invention to provide an elongated, flexible body cleansing brush for effectively reaching and cleaning hard-to-reach areas of the body.

It is another object of the present invention to provide an ergonomically-conforming brush which can accommodate the multitude of various curves and contours of the body.

It is still another object of the present invention to provide a body cleansing brush with an arcuate-shaped extension arm.

It is still another object of the present invention to provide an elongated, tubular primary arm.

It is another object of the present invention to provide a flexible elastomeric tubular coupler for flexibly adjoining the primary arm to the extension arm.

It is another object of the present invention to provide a durable cleansing sponge particularly useful for washing and exfoliating one's skin.

It is another object of the present invention to provide a flexible, cushioned, rubber handle adapted for use in a shower or bath.

Briefly described according to one embodiment of the present invention, a flexible body cleansing brush with angularly-adaptable head is provided having an elongated, tubular body with a rubber handle positioned at one end, and an applicator/cleansing sponge located at an opposite end. A flexible elastomeric tubular coupler flexibly adjoins a primary arm to an extension arm. The flexible elastomeric coupler allows the extension arm to move pivotally, with unlimited angular relation with respect to the primary arm.

The applicator/cleansing sponge is fabricated of a polysulfone/polyurethane conjugate foam which allows the sponge to retain dimensional stability when in contact with a cleansing agent, and is also durable.

The use of the present invention allows a user to more effectively and easily wash areas of the body being difficult to reach.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
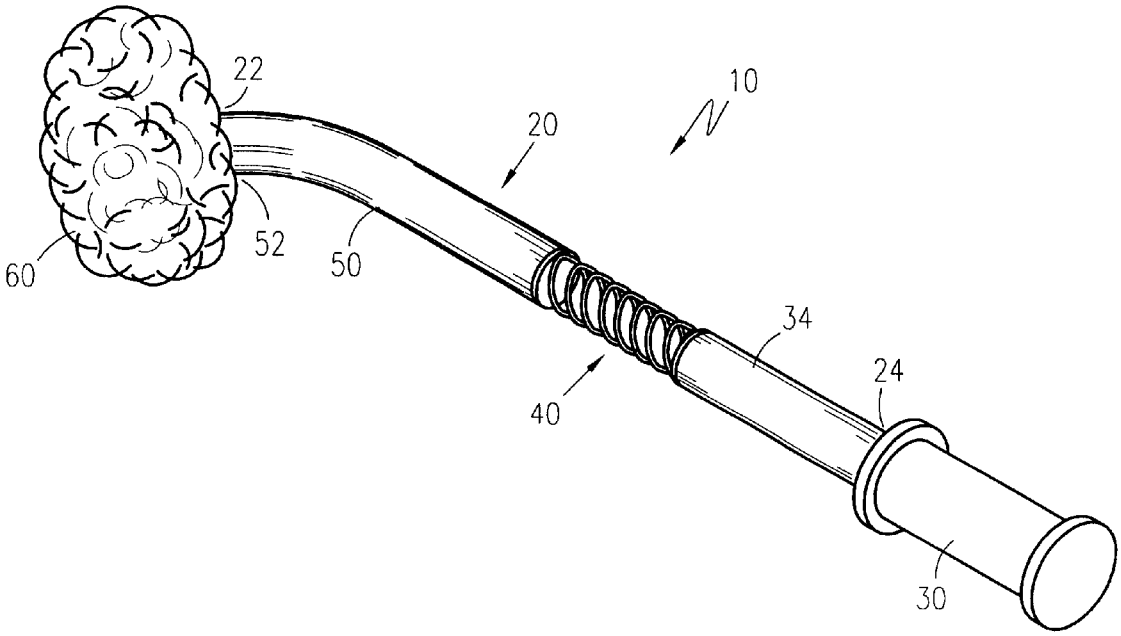
FIG. 1 is a perspective view of a flexible body cleansing brush with angularly-adaptable head according to the preferred embodiment of the present invention.
Figure 2:
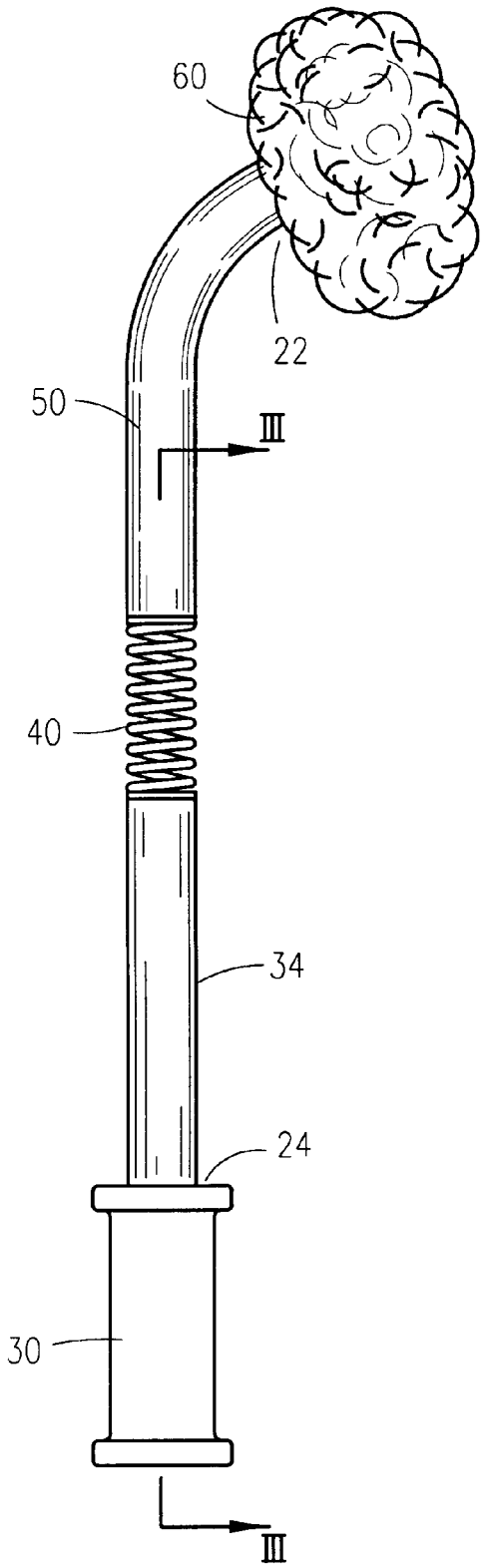
FIG. 2 is a side elevational view of the flexible body cleansing brush with angularly-adaptable head according to the preferred embodiment of the present invention.
Figure 3:
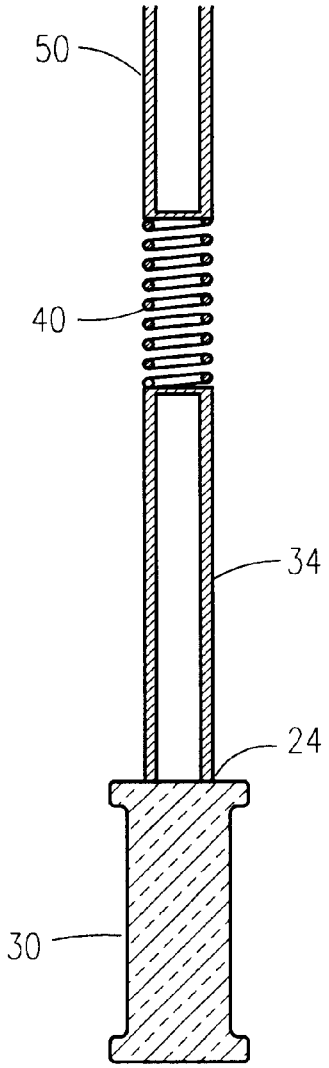
FIG. 3 is a cross-sectional view of the flexible body cleansing brush with angularly-adaptable head taken along lines III—III of FIG. 2 according to the preferred embodiment of the present invention.

Referring now to FIGS. 1–3, a flexible body cleansing brush with angularly-adaptable head 10 is shown, according to the present invention, comprised of an elongated, tubular body 20 having a distal end 22 opposite a proximal end 24. The proximal end 24 is comprised of a flexible, cushioned, rubber handle 30 suitably adhered to a primary arm 34 (to be described in greater detail below). It is envisioned that the handle 30 may be formed alternatively of impact modified moldable polymeric plastics or similar suitable materials. However, being fabricated of a flexible, cushioned rubber material, the handle 30 facilitates enhanced grip therearound by the hand of a user, thereby being better adapted for use in a wet environment, such as in a shower or bath.

The primary arm 34 is of an elongated, tubular configuration fabricated of a rubber or plastic material.

A flexible elastormeric tubular coupler 40 is utilized to flexibly adjoin the primary arm 34 to an elongated, arcuate tubular extension arm 50. The flexible elastomeric tubular coupler 40 allows the extension arm 50 to move pivotally, with unlimited angular relation with respect to the primary arm 34. The flexible elastomeric tubular coupler 40 is formed of an integral, substantially helical sectioning 42, thereby providing a connection allowing for movement or flexure by the extension arm 50 in vertical and horizontal angular planes upon pressure being applied thereagainst. The extension arm 50 is fabricated of a rubber or plastic material.

The distal end 22 of the flexible body cleansing brush with angularly-adaptable head 10 is comprised of an applicator/cleansing sponge 60 suitably adhered to an upper end 52 of the extension arm 50. The applicator/cleansing sponge 60 is fabricated of a large-cell, open-cell polysulfone/polyurethane conjugate foam. Such fabrication design allows the applicator/cleansing sponge 60 to retain dimensional stability when in contact with a cleansing and emulsifying agent, and is also wear-resistant. Thus, the applicator/cleansing sponge 60 as heretofore described is particularly if not ideally useful for both washing and exfoliating one's skin, and for providing a durable body-cleansing device.

The elongated design and angular adaptability of the extension arm 50 of the present invention allow a user to wash areas of the body which are difficult to reach, such as the back and lower legs. In addition, use of the present invention provides a user with a means by which areas being difficult to reach, due to chronic back or arthritic conditions and which require one to bend or twist, can be overcome and washed more effectively and easily.

2. Operation of the Preferred Embodiment

To use the present invention, a user applies a suitable portion of a cleansing agent to the applicator/cleansing sponge 60. Next, the user grasps the handle 30 and washes the back, lower legs, and the entire body.

The use of the present invention allows a user to more effectively and easily wash areas of the body being difficult to reach.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A cleaning brush comprising:

a primary arm of an elongated, tubular configuration:

an elongated, arcuate tubular extension arm; and a flexible elastomeric tubular coupler for flexibly adjoining said primary arm to said extension arm, wherein said flexible elastomeric tubular coupler is formed of an integral, substantially helical sectioning, thereby providing a connection allowing for movement or flexure by the extension arm in vertical and horizontal angular planes upon pressure being applied thereagainst;

an angularly-adaptable head affixed to a distal end of said primary arm; and cleaning brush means affixed to said head.

2. The cleaning brush of claim 1, further comprising a flexible, cushioned, rubber handle affixed to said primary arm.

3. The cleaning brush of claim 1, wherein said primary arm is formed of impact modified moldable polymeric plastic.

4. The cleaning brush of claim 1, wherein said cleaning brush means is comprised of an applicator/cleansing sponge suitably adhered to an upper end of the extension arm.

5. The cleaning brush of claim 4, wherein said applicator/cleansing sponge is fabricated of a large-cell, open-cell conjugate foam.

* * * * *